US006409529B1

(12) United States Patent
Liu et al.

(10) Patent No.: US 6,409,529 B1
(45) Date of Patent: Jun. 25, 2002

(54) SIM CARD CONNECTOR WITH IMPROVED GROUNDING PIN

(75) Inventors: Jun Xian Liu; Shaoping Du; Jian Qiang Zhang, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/875,626

(22) Filed: Jun. 5, 2001

(30) Foreign Application Priority Data

Apr. 30, 2001 (TW) ..... 90206961 U

(51) Int. Cl.[7] ..... H01R 29/00
(52) U.S. Cl. ..... 439/188; 439/630
(58) Field of Search ..... 439/188, 630, 439/862, 924.1

(56) References Cited

U.S. PATENT DOCUMENTS 4,986,765 A * 1/1991 Kosumaki et al. ..... 439/326
5,259,777 A * 11/1993 Schuder et al. ..... 439/188
5,879,169 A * 3/1999 Wu ..... 439/74
5,885,090 A * 3/1999 Comstock et al. ..... 439/65
5,924,881 A * 7/1999 Yasushi et al. ..... 439/188
6,004,155 A * 12/1999 Wu ..... 439/489
6,086,425 A * 7/2000 Lescoat ..... 439/630

* cited by examiner

*Primary Examiner*—Neil Abrams
*Assistant Examiner*—J. F. Duverne
(74) *Attorney, Agent, or Firm*—Wei Te Chung

(57) ABSTRACT

A Subscriber Identity Module connector (1) includes an insulative housing (10) having a front and a rear rows of recesses (11), a plurality of terminals (20) retained in the recesses with contact portions (21) extending beyond a top surface of the housing for being horizontally exerted on by a SIM card (40), and a grounding pin (30) retained in a front portion of the recess of the rear row with a transitional portion (311) extending upwardly and forwardly beyond the top surface of the housing for being horizontally exerted on by the SIM card. During insertion, a SIM card slides on the grounding pin and exerts horizontal force on the transitional portion of the grounding pin to form the working circuit after the contact pads of the card fully engage with the contact portions of the terminals.

6 Claims, 8 Drawing Sheets

SIM CARD CONNECTOR WITH IMPROVED GROUNDING PIN

FIELD OF THE INVENTION

The present invention generally relates to a Subscriber Identity Module (SIM) card connector, and more particularly to a SIM card connector with improved grounding pin.

BACKGROUND OF THE INVENTION

It is well known that Subscriber Identity Module (SIM) card connectors are used in mobile devices to receive SIM cards therein. U.S. Pat. No. 5,259,777 discloses a conventional SIM card connector provided with a card detection switch. The SIM card connector has a plurality of reading contact elements and an additional contact element. Each reading contact element has a detent zone, and a contacting zone. The contacting zone is provided with a contact cusp projecting upwardly for an electrical connection with circuit trace of the SIM card, and an abutment portion at a distal end of the contacting zone. The additional contact element includes a termination and a detent zone as well as a contact zone. The contact zone has a broadened contact surface located immediately below the abutment portion of one of the reading contact elements, which is connected to ground, i.e., to the so-called ground contact element. A card is inserted into the connector and slides over the ground contact element. The contact cusp of the ground contact element is pressed down and a lower abutment surface of the abutment portion abuts the contact surface of the additional contact element. Therefore, signal transmission is achieved.

According to the multifunction requirement of the mobile devices, one mobile device may need more than one SIM card, thus the insertion or withdrawal of one SIM card should not affect working of other SIM cards. However, the additional contact element of the SIM card connector described above contacts the ground contact element simultaneously as the SIM card slides over the ground contact element and the working circuit is formed. Thus the mobile device is required to shut down the power during insertion and withdrawal of the SIM card, otherwise the SIM card is easy to be damaged by the surge of the current.

Hence, an improved SIM card connector is needed to overcome the forgoing shortcomings.

BRIEF SUMMARY OF THE INVENTION

A main object of the present invention is to provide a SIM card connector used with a mobile device permitting insertion and withdrawal of the SIM card with power of the mobile device on.

Another object of the present invention is to provide a SIM card connector with a grounding pin.

A SIM card connector according to the present invention comprises an insulative housing having a front and a rear row of recesses, a plurality of terminals retained in the recesses and a grounding pin retained in one recess of the front row together with one of the terminals which is a grounding terminal. Contact portions of the terminals and a transitional portion of the grounding pin project upwardly over a top surface of the housing and the transitional portion is located in front of the contact portions of the terminals. The grounding pin has an abutment portion located immediately below an abutment leg of the grounding terminal.

During insertion, the SIM card slides over the SIM card connector and contact pads of the card come into engaging contact portions of the connector gradually. After the contact pads of the card fully engage with the contact portions of the connector, the card slides on the grounding pin and exerts a horizontal force on the transitional portion of the grounding pin. The abutment portion of the grounding pin contacts the abutment leg of the grounding terminal to form the working circuit. During withdrawal, the contact pads of the card disengage with the transitional portion of the grounding pin first, the abutment portion of the grounding pin disengages with the abutment leg of the grounding terminal, and the working circuit is broken. Then the contact pads of the card disengage with contact portions of the connector. The SIM card is protected from being damaged by the surge of the current.

Other objects, advantages and novel feather of the invention will become more apparent from the following detailed description when taken in conjunction with the accompanying drawings.

DETAILED DESCRIPTION OF THE INVENTION

Figure 1:
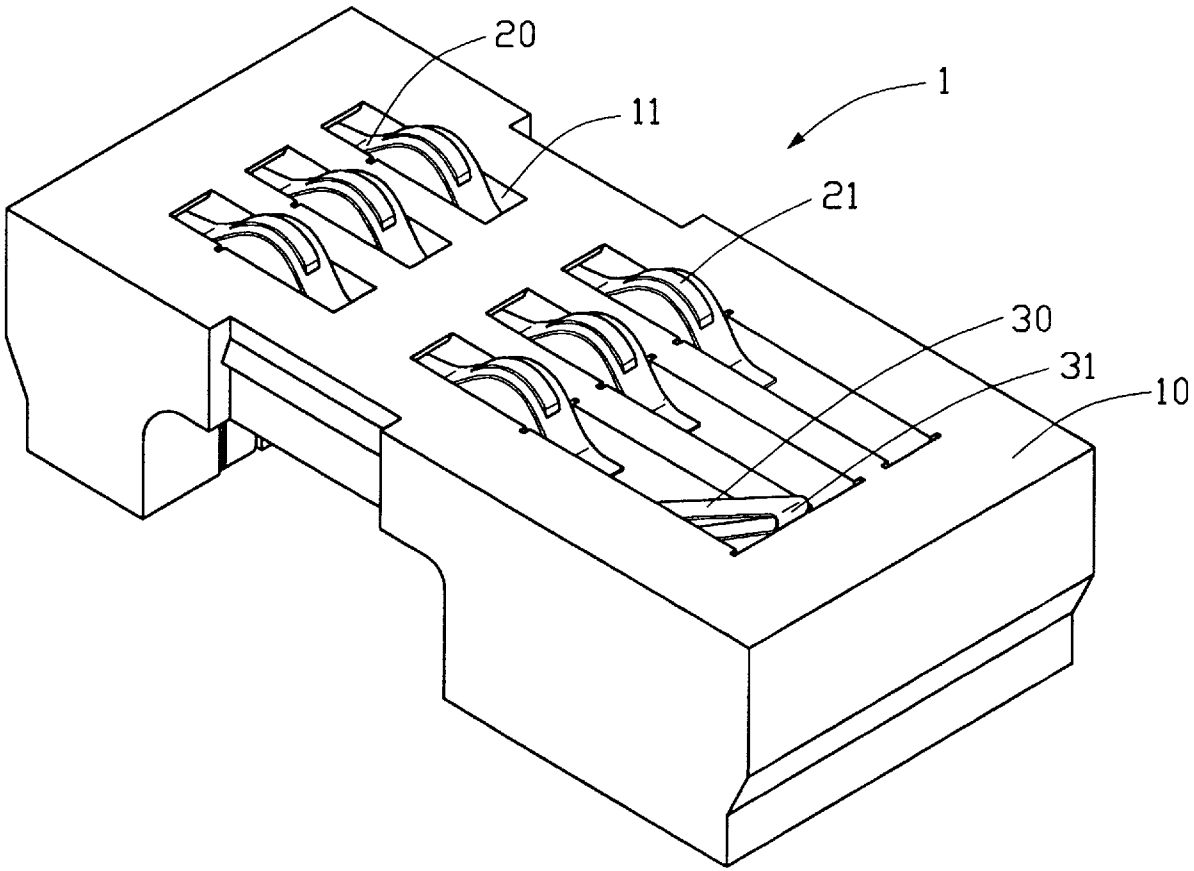
FIG. 1 is a perspective view of a SIM card connector according to a preferred embodiment of the present invention.

Referring to FIG. 1, a SIM card connector 1 for use with a mobile device (not shown) according to a preferred embodiment of the present invention includes an insulative housing 10, a plurality of terminal 20 and a grounding pin 30.

The housing 10 defines a front and a rear row of recesses 11 exposed to a top surface thereof.

Figure 2:
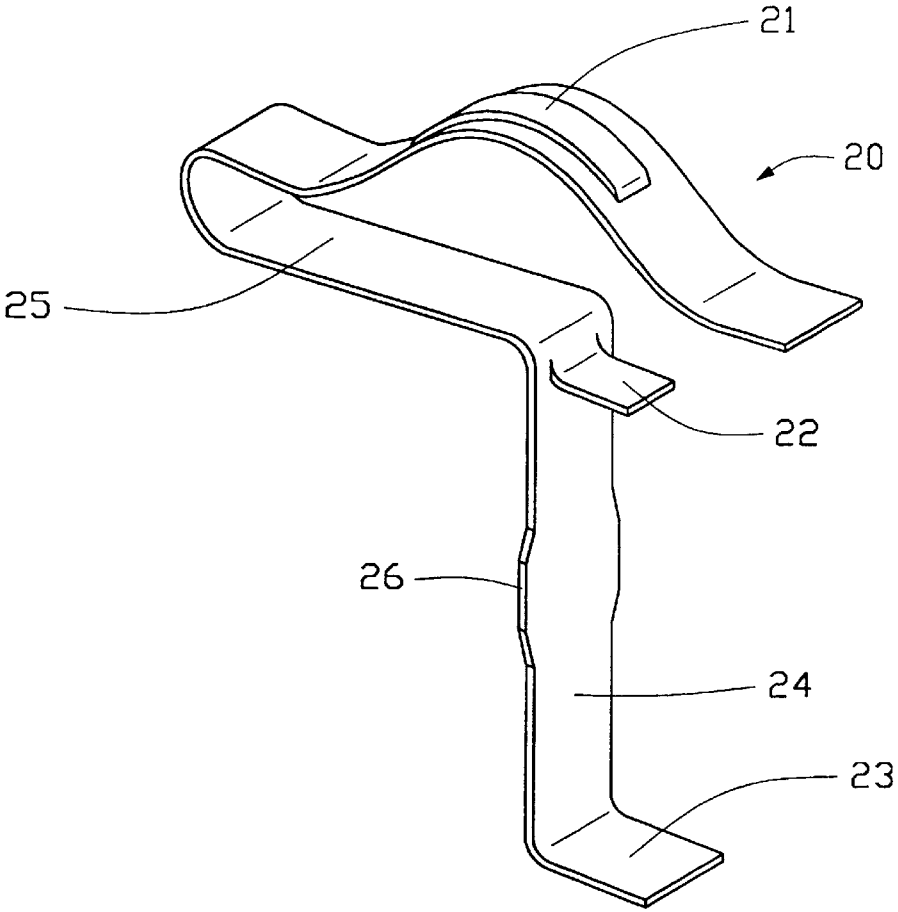
FIG. 2 is a perspective view of a terminal of the SIM card connector of FIG. 1.

Referring to FIG. 2. Each terminal 20 includes a mounting portion 24, a solder tail 23 extending transversely from a lower end of the mounting portion 24, a bended flexible portion 25 extending rearwardly from an upper end of the mounting portion 24, and an abutment leg 22 extending forwardly from the upper end of the mounting portion 24. A contact portion 21 projects upwardly from the flexible portion 25. Each mounting portion 24 has a pair of barbs 26 protruding laterally from opposite sides thereof.

Referring to FIG. 2, the grounding pin 30 is stamped from a metal sheet and has a vertical mounting portion 34, a transverse abutment portion 32 and a folded contact portion 31 connecting the mounting portion 34 and the abutment portion 32. The mounting portion 34 has a pair of barbs 341 on opposite sides thereof. A solder portion 33 extends from a lower end of the mounting portion 34. The abutment portion 32 has an abutment protrusion 321 on a top surface thereof. A transitional portion 311 of the folded contact portion 31 projects upwardly.

Figure 3:
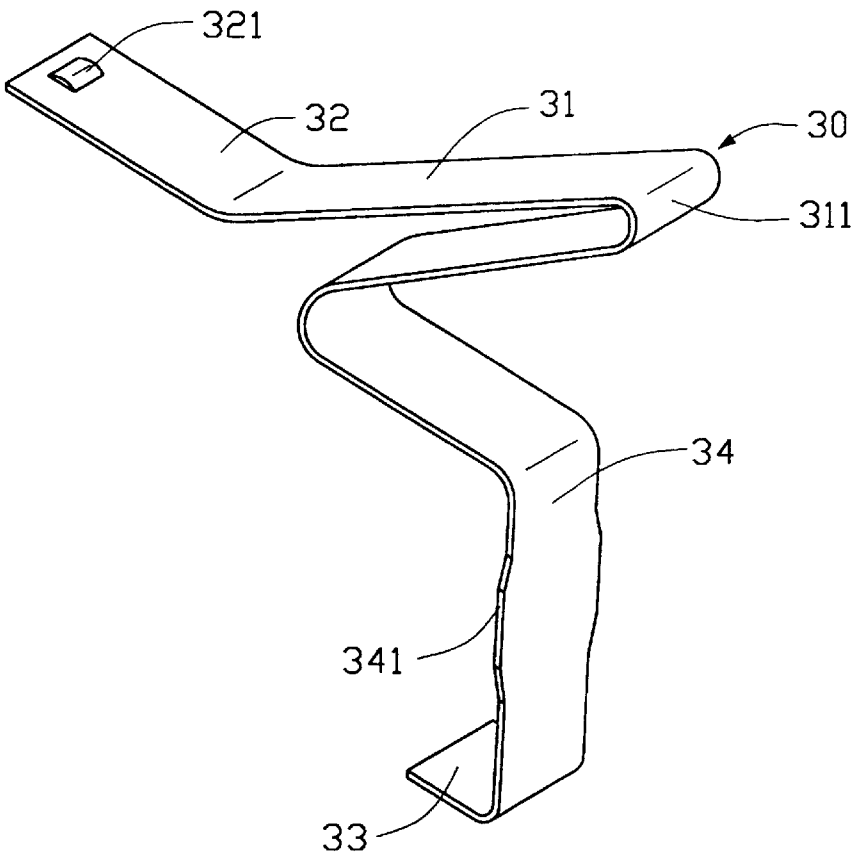
FIG. 3 is a perspective view of a grounding pin of the SIM card connector.

Referring to FIGS. 1 and 3, in assembly, each terminal 20 is retained in a corresponding recess 11 of the housing 10 with the barbs 26 respectively engaging with channels (not shown) of the housing 10, thereby securing the terminal 20 in the housing 10. The grounding pin 30, together with one of the terminals 20 which serves as a grounding terminal, are retained in a front portion of one recess 11 of the front row. The contact portion 21 of each terminal and the transitional portion 311 projects over a top surface of the housing 10 for being horizontally exerted on by a SIM card 40 inserted into the connector 1. The transitional portion 311 is located ahead of the contact portions 21. The abutment portion 32 of the grounding pin 30 is located below the abutment leg 22. The solder tails 23 and the solder portion 33 are soldered to grounding pad (not shown) of the PCB 50.

Figure 4:
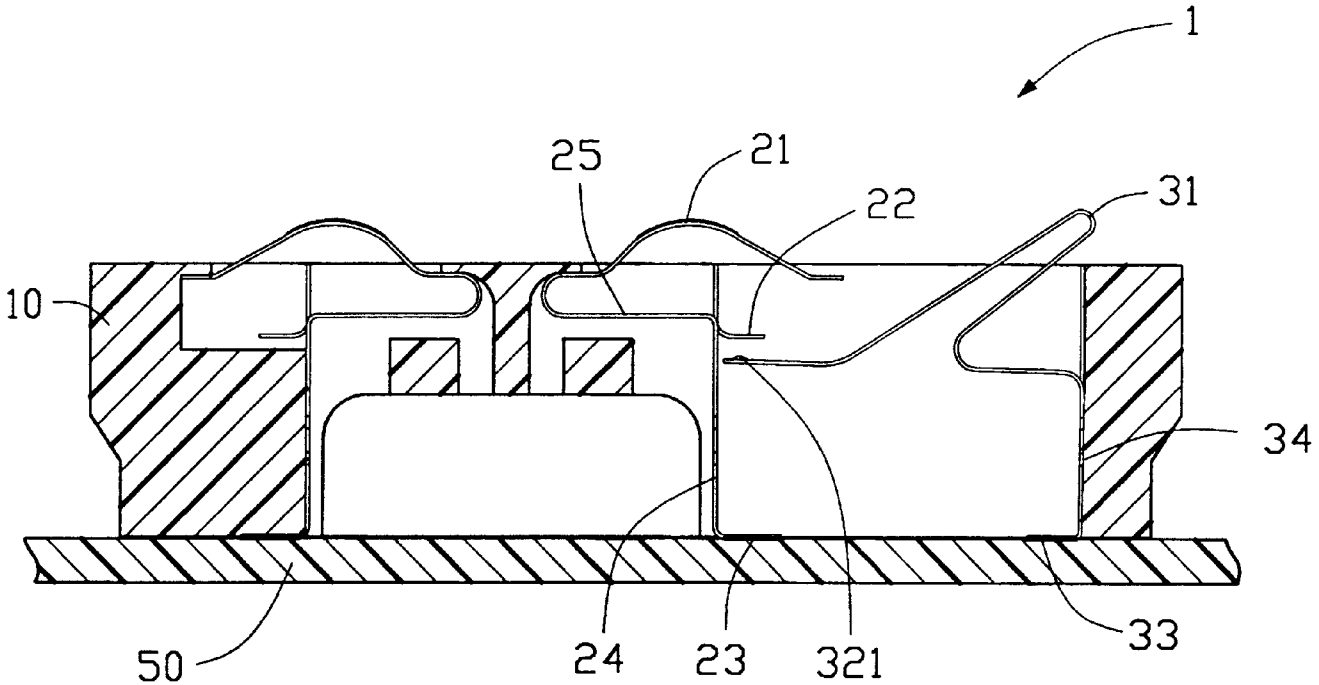
FIG. 4 is a cross-sectional view of the SIM card connector.
Figure 5:
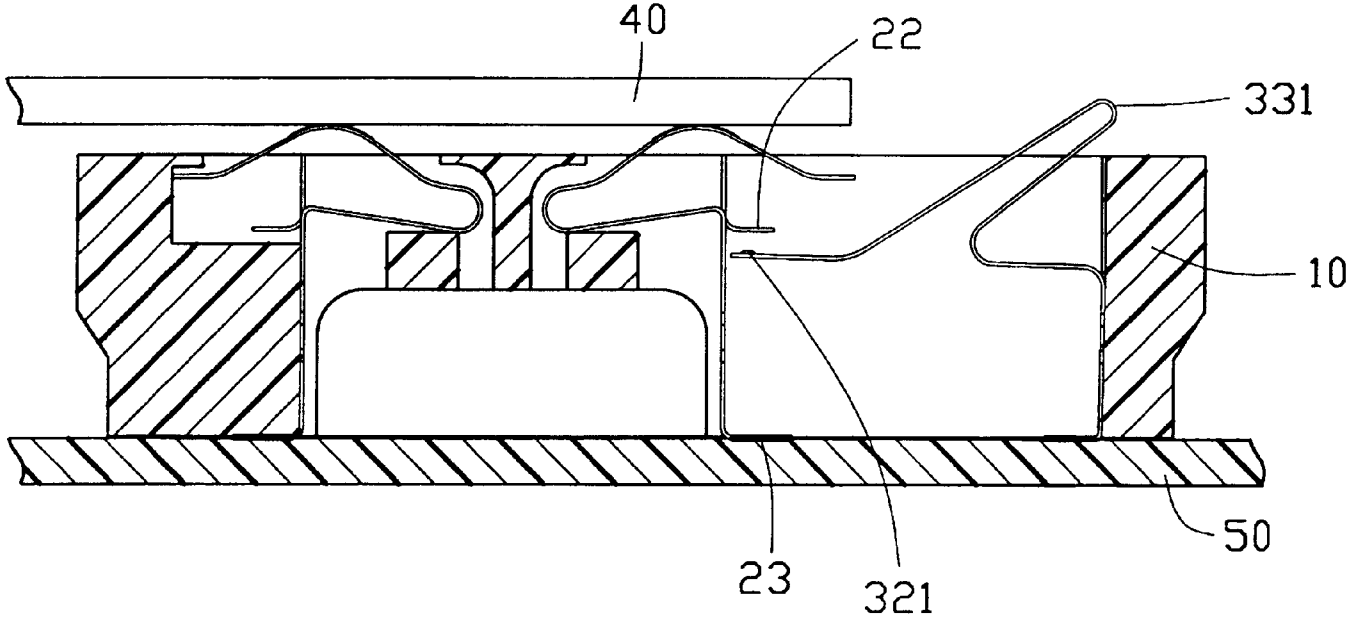
FIG. 5 is a cross sectional view the SIM card connector and a SIM card thereon, wherein the SIM card is not in its final position in the connector.

During insertion of the card 40 into the connector 1, the card 40 slides forwardly into the connector 1 with power of the mobile device on as shown in FIG. 4. The contact pads (not labeled) of the SIM card 40 come into contacting with the contact portions 21 of the connector 1 gradually. After the contact pads of the card 40 fully engage with the contact portions 21 of the connector 1, the card 40 slides on the grounding pin 30 and exerts horizontal force on the transitional portion 311. The abutment portion 32 of the grounding pin 30 moves upwardly, and the abutment protrusion 321 abuts the abutment leg 22 of the grounding terminal 20 as shown in FIG. 5. The working circuit trace is then formed.

During withdrawal of the card 40, the card 40 slides rearwardly from the connector 1. The contact pads of the card 40 disengage with the transitional portion 311 of the grounding pin 30 first, the abutment protrusion 321 of the grounding pin 30 disengages with the abutment leg 22 of the grounding terminal 20, and the working circuit is broken. Then the contact pads of the card 40 disengage with contact portions 21 of the connector 1. The card 40 is protected from being damaged by the surge of the current.

Figure 6:
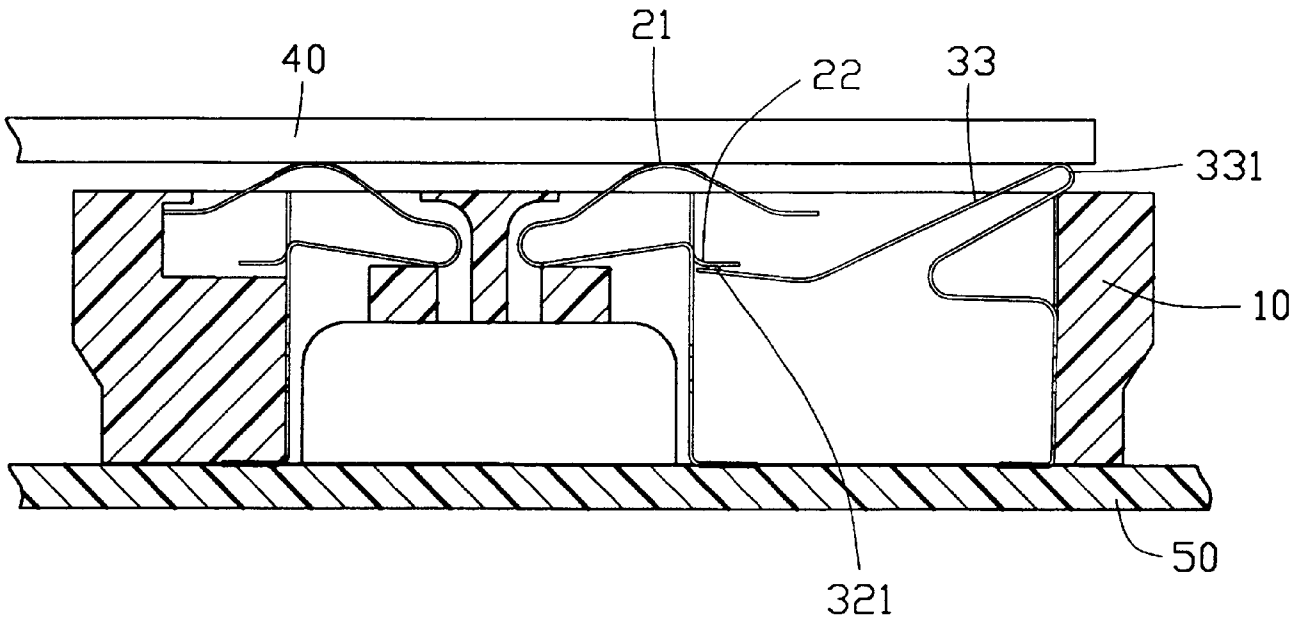
FIG. 6 is a cross sectional view the SIM card connector and a SIM card thereon, wherein the SIM card is in its final position in the connector.
Figure 7:
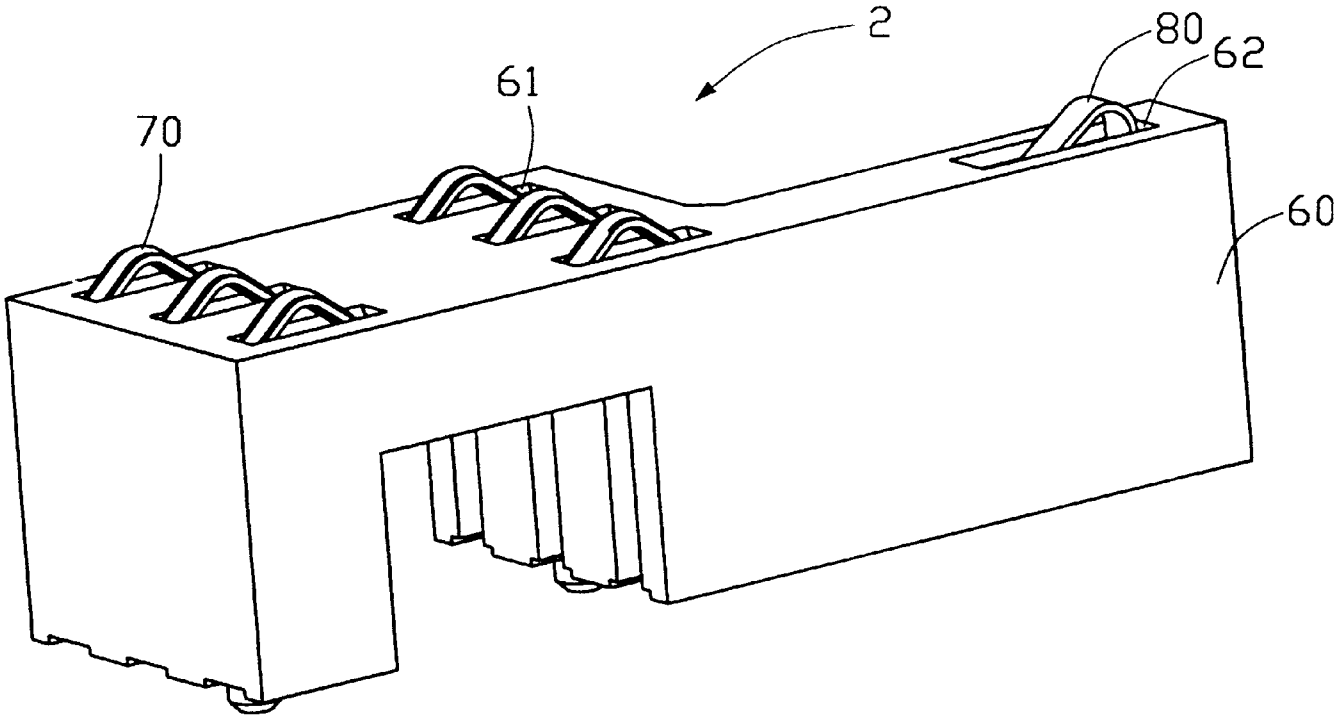
FIG. 7 is a SIM card connector according to another embodiment of the invention.
Figure 8:
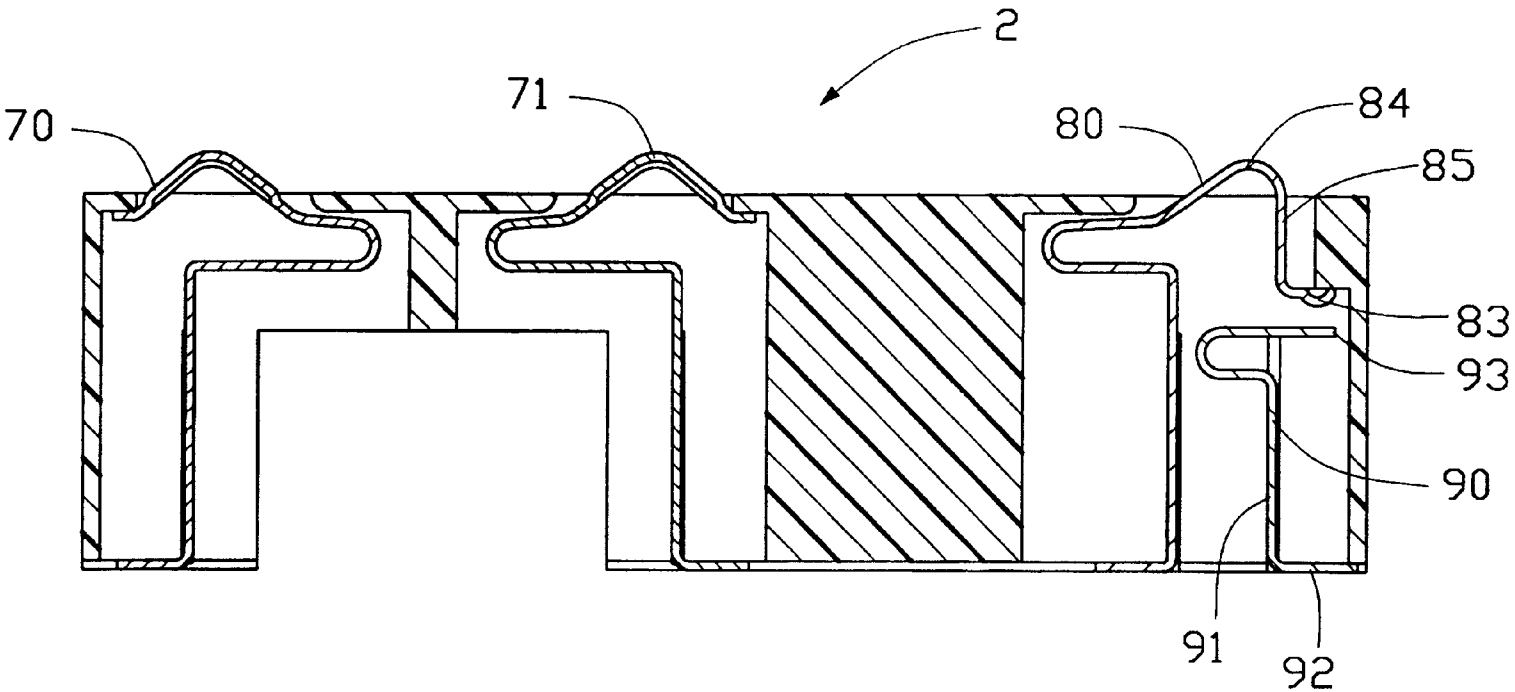
FIG. 8 is a cross-sectional view of the SIM card connector of FIG. 6.

FIGS. 6 and 7 show a SIM card connector 2 used with a mobile device (not shown) according to another embodiment of the invention. The SIM card connector 2 includes an insulative housing 60, a plurality of terminals 70, a first and a second switching terminals 80, 90.

Referring to FIG. 6, the insulative housing 60 is substantially L-shaped. Two rows of terminal recesses 61 are defined in a rear portion of a top surface of the housing 60 for retaining the terminals 70. A switch recess 62 is defined in a front portion of the top surface of the housing 60 for retaining the first and the second switch terminals 80, 90.

Referring to FIG. 7, each terminal 70 is substantially the same with the terminal 20 described in the first embodiment, except that the terminal 70 has no abutment leg extending laterally. The first switch terminal 80 is also substantially the same with the terminal 20 except that a flexible portion 85 of the first switch terminal 80 has a switch contact portion 83 projecting downwardly from a flexible portion 85 and a contacting cusp 84 extending upwardly. The second switch contact 90 has a vertical mounting portion 91, a transverse solder portion 92 extending from a lower end of the mounting portion 91, and a U-shaped flexible mating portion 93 projecting laterally from an upper end of the mounting portion 91.

During assembly, each terminal 70 is retained in a corresponding terminal recess 61, with contact portions 71 projecting beyond a top surface of the housing 60. The first and the second switch contacts 80, 90 are retained in the switch recess 62. The contact cusp 84 of the first switch contact project upwardly beyond the top surface of the housing 60. The flexible mating portion 93 of the second switch contact 90 is below the switch contact portion 83 of the first switch contact 80.

During insertion of a SIM card (not shown), it slides forwardly into the connector 60 with power of the mobile device acted. The contact pads (not shown) of the SIM card come into contacting with contact portions of the connector 60 gradually. After the contact pads of the card fully engage with the contact portions of the connector 60, the card slides on the first switch contact 80 and exerts horizontal force on the contacting cusp 84. The flexible portion 85 is bent and the switch contact portion 83 moves downwardly to contact the mating portion 93 of the second switch contact 90. The working circuit trace is then formed.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A Subscriber Identity Module (SIM) card connector comprising:

an insulative housing defining a front and a rear rows of recesses on a top surface thereof;

a plurality of terminals retained in the recesses, each terminal having a contact portion extending beyond the top surface of the housing, one of the terminals being a grounding terminal, the grounding terminal having an abutment leg; and a grounding pin having a mounting portion retained in one of the front row recesses, a solder portion adapted for contacting grounding pad of a printed circuit board, an abutment portion located below the abutment leg of the grounding terminal, and a folded contact portion between the mounting portion and the abutment portion, the folded contact portion having a transitional portion extending beyond the top surface of the housing in front of the contact portions of the terminals, the transitional portion of the folded contact portion being rearwardly and downwardly moveable by a SIM card to move the abutment portion upwardly to abut the abutment portion of the grounding terminal.

2. The SIM card connector of claim 1, wherein the grounding terminal includes a mounting portion, a solder tail extending laterally from a lower end of the mounting portion, a bended flexible portion extending rearwardly from an upper end of the mounting portion, and the abutment leg extending forwardly from the upper end of the mounting portion.

3. The SIM card connector of claim 1, wherein the mounting portion of the grounding pin is vertically mounted in the housing, the folded contact portion connects to an upper end of the mounting portion with the transitional portion extending upwardly and forwardly, and the abutment portion extending horizontally from a rear end of the folded contact portion.

4. The SIM card connector of claim 3, wherein the abutment portion of the grounding pin has an abutment protrusion on a top surface thereof.

5. An electrical connector for use with a SIM card, comprising:

an insulative housing defining a plurality of recesses therein and a top surface thereon;

a plurality of terminals received within the corresponding recesses, respectively, each of said terminals including a first moveable contact portion extending above the top surface and an immoveable retention portion; and a grounding pin sharing a same recess with one of said terminals, said grounding pin including a second moveable contact portion extending above the top surface, and a moveable abutment portion extending from said second moveable contact portion; wherein said moveable abutment portion experiences engagement/disengagement change with the immoveable retention portion of the corresponding terminal sharing the same recess therewith, when the SIM card is seated upon the top surface.

6. The connector of claim 5 wherein said abutment portion is spaced from the retention portion of the corresponding terminal when said grounding pin is in a free status.

* * * * *